US009052665B2

(12) United States Patent
Ishida et al.

(10) Patent No.: US 9,052,665 B2
(45) Date of Patent: Jun. 9, 2015

(54) IMAGE FORMING APPARATUS

(71) Applicant: KYOCERA Document Solutions Inc., Osaka-shi, Osaka (JP)

(72) Inventors: Hideki Ishida, Osaka (JP); Hiroki Tanaka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/463,493

(22) Filed: Aug. 19, 2014

(65) Prior Publication Data

US 2015/0063849 A1 Mar. 5, 2015

(30) Foreign Application Priority Data

Aug. 28, 2013 (JP) ..... 2013-177254

(51) Int. Cl.
*G03G 15/00* (2006.01)
*G03G 15/06* (2006.01)

(52) U.S. Cl.
CPC ..... *G03G 15/5041* (2013.01); *G03G 15/065* (2013.01)

(58) Field of Classification Search
USPC ..... 399/38, 46, 49, 53–56
See application file for complete search history.

(56) References Cited

U.S. PATENT DOCUMENTS 8,610,950 B2 * 12/2013 Ishii ..... 358/1.9
2011/0158667 A1 * 6/2011 Ishii ..... 399/49

FOREIGN PATENT DOCUMENTS

| | | | |
|---|---|---|---|
| JP | 11196277 | A | 7/1999 |
| JP | 2002055496 | A | 2/2002 |
| JP | 2003156889 | A | 5/2003 |
| JP | 2006195233 | A | 7/2006 |
| JP | 2011059625 | A | 3/2011 |
| JP | 2012015864 | A | 1/2012 |

* cited by examiner

*Primary Examiner* — Hoan Tran
(74) *Attorney, Agent, or Firm* — Alleman Hall McCoy Russell & Tuttle LLP

(57) ABSTRACT

In an image forming apparatus, a high-density portion and a low-density portion are arranged close to each other such that a boundary between the high-density portion and the low-density portion intersects with the conveyance direction of a density detection patch. A controller compares, in the conveyance direction, temporal change in the density detection value at a boundary portion shifting from the high-density portion to the low-density portion, with temporal change in the density detection value at a boundary portion shifting from the low-density portion to the high-density portion, and sets a process condition based on a result of the comparison.

10 Claims, 12 Drawing Sheets

DEVELOPMENT LIMIT TONER AMOUNT < SUPPLY LIMIT TONER AMOUNT

DEVELOPMENT LIMIT TONER AMOUNT ≈ SUPPLY LIMIT TONER AMOUNT

DEVELOPMENT LIMIT TONER AMOUNT > SUPPLY LIMIT TONER AMOUNT

DEVELOPMENT LIMIT TONER AMOUNT >> SUPPLY LIMIT TONER AMOUNT

IMAGE FORMING APPARATUS

INCORPORATION BY REFERENCE

This application is based upon and claims the benefit of priority from the corresponding Japanese Patent Application No. 2013-177254 filed on Aug. 28, 2013, the entire contents of which are incorporated herein by reference.

BACKGROUND

The present disclosure relates to an image forming apparatus.

In an image forming apparatus such as a copy machine, a printer, a facsimile machine, or a multifunction peripheral, it is known that when an electrostatic latent image is formed on a photosensitive drum in accordance with image data, a development electric field intensity at an end portion of an image increases due to edge effect, and the toner amount used for development increases. Further, a halo effect is also known in which, at a portion where an outputted image changes from a low-density portion to a high-density portion in the sub scanning direction, toner moves from the low-density portion to the high-density portion, whereby the density at a rear end portion of the low-density portion, that contacts the high-density portion, decreases.

One image forming apparatus detects density change in the advancing direction of an image carrier, and performs light amount correction to gradually decrease the light amount from the boundary of the density change.

Another image forming apparatus forms a patch having a high-density portion and a low-density portion that are close to each other, detects image defect at the boundary between the high-density portion and the low-density portion, and controls a development bias and the like, thereby correcting the image defect at the boundary between the high-density portion and the low-density portion.

Still another image forming apparatus changes an image formation condition (particularly, development sleeve rotation rate, doctor blade gap, distance between drum and development sleeve, etc.) in accordance with characteristics change in a region from a halftone portion to a solid portion.

Still another image forming apparatus forms a high-density image and a low-density image having an edge intersecting with the movement direction of a transfer body, and performs discharge and supply of toner of a developing device based on the density at the adjacent portion therebetween.

Still another image forming apparatus adjusts the exposure amount based on a result of detection by means for detecting an edge at which a high-density region and a low-density region in an image pattern are adjacent to each other.

Still another image forming apparatus detects, as reflected light amount, the density at a rear end portion of a toner patch image formed on a photosensitive drum, and controls a grid application voltage and a development bias.

SUMMARY

An image forming apparatus according to one aspect of the present disclosure includes a photosensitive body, a charging device, an exposure device, a developing device, a density sensor, and a controller. The charging device is configured to charge a surface of the photosensitive body based on a process condition. The exposure device is configured to radiate light to the photosensitive body, to form an electrostatic latent image. The developing device is configured to develop the electrostatic latent image with toner based on the process condition, to form a toner image. The density sensor is configured to detect a density of the toner image. The controller is configured to cause a density detection patch to be formed as the toner image and set the process condition based on a density detection value of the density detection patch detected by the density sensor. The density detection patch has a high-density portion and a low-density portion. The high-density portion and the low-density portion are arranged close to each other such that a boundary between the high-density portion and the low-density portion intersects with a conveyance direction of the density detection patch. The controller compares, in the conveyance direction, temporal change in the density detection value at a boundary portion shifting from the high-density portion to the low-density portion, with temporal change in the density detection value at a boundary portion shifting from the low-density portion to the high-density portion, and sets the process condition based on a result of the comparison.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

In a development method in which the rotation direction of a developing roller coincides with the rotation direction of a photosensitive body in a development region (particularly, a touchdown development method), a range of about 1 to 2 mm at a rear end of a solid image may be developed with a large amount of toner, or in the case where a solid image is close to the rear side in the sheet passing direction of a half pattern image, void may occur in a range of about 1 to 2 mm at a rear end of the half pattern image.

Either of these phenomena is caused because the development electric field at the solid image portion is stronger than in the periphery thereof so that the toner is attracted from the periphery. Therefore, these phenomena are strongly influenced by a development bias setting or the rotation direction of the developing roller. Particularly, in the case where a DC component of the development bias is set so as to increase a development degree, such failure at the end of the image becomes significant.

This is due to the magnitude relationship between a development limit toner amount that can be developed at a latent image portion of a solid image on the photosensitive body by a development bias, and a supply limit toner amount that can be supplied from the developing roller.

Figure 11A:
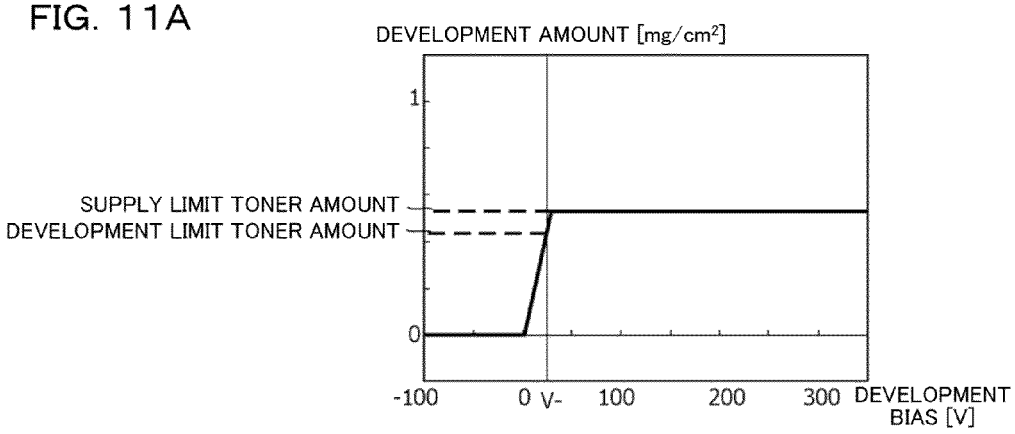
FIG. 11A, FIG. 11B, and FIG. 11C are diagrams for explaining the relationship between the development limit toner amount corresponding to each development bias, and a supply limit toner amount.
Figure 11B:
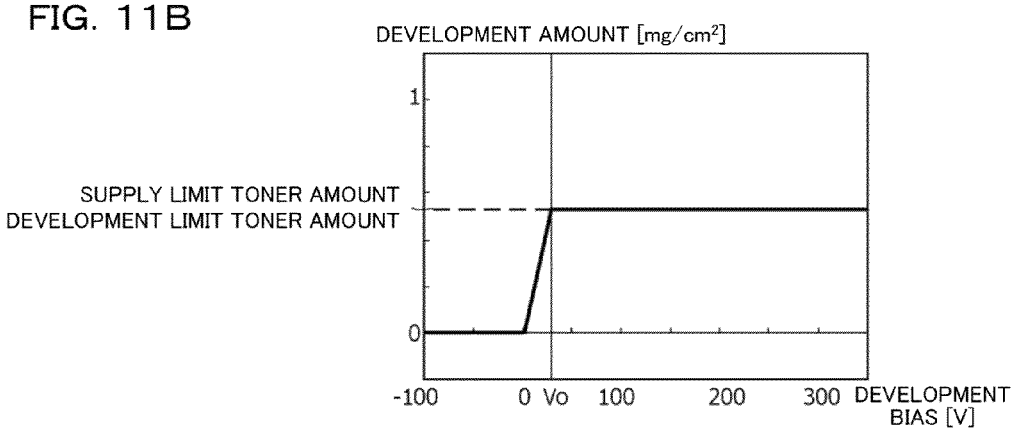
Figure 11C:
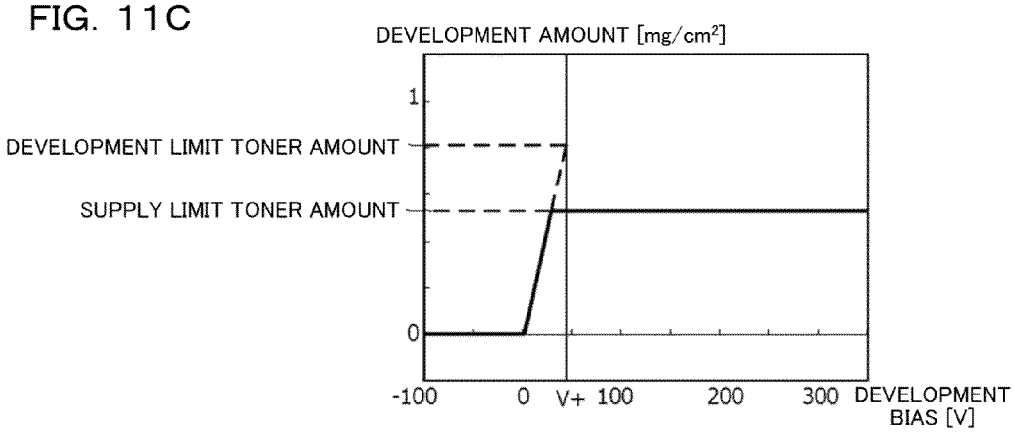
Figure 12A:
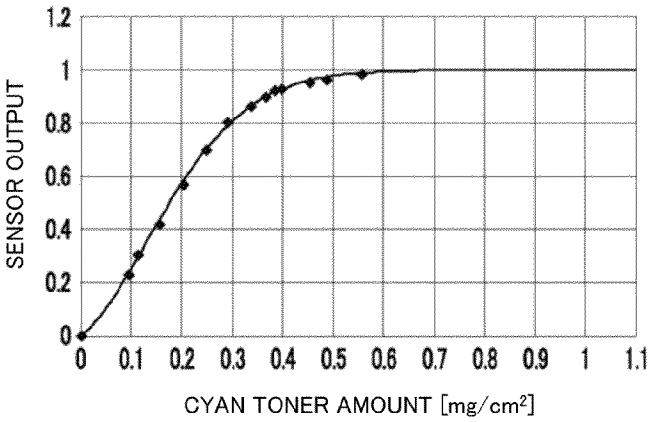
FIG. 12A, FIG. 12B, FIG. 12C, and FIG. 12D are diagrams for explaining a characteristic of a reflection-type density sensor.
Figure 12B:
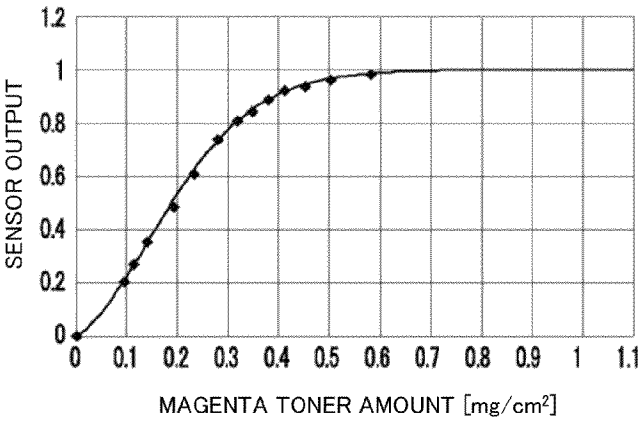
Figure 12C:
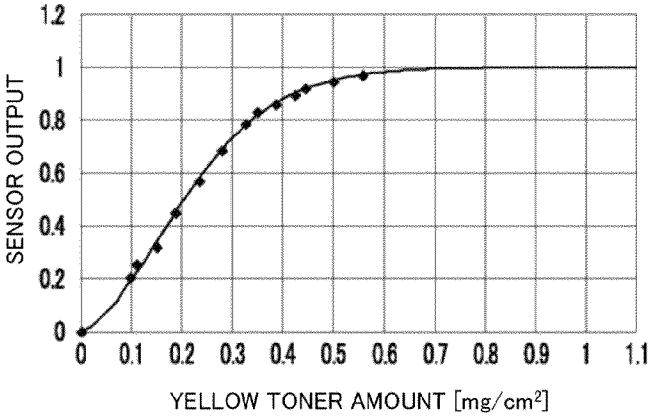
Figure 12D:
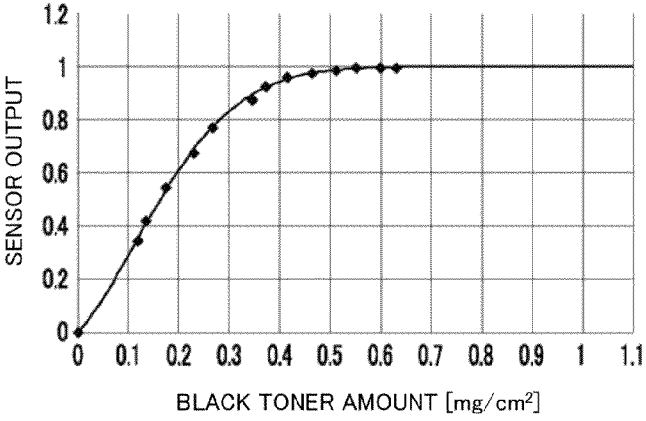

As shown in FIG. 11A, FIG. 11B, and FIG. 11C, in the case where the development bias is a value V+ which is greater than a proper bias value Vo at the minimum saturation point of the development amount, the development limit toner amount becomes larger than the supply limit toner amount, and therefore toner can be attracted from the periphery to an end portion of a solid image, thus leading to failure at the image end. On the other hand, in the case where the development bias is a value V− which is smaller than the bias value Vo, the development limit toner amount becomes smaller than the supply limit toner amount, and therefore occurrence of failure at the image end can be suppressed. However, in the case of using a photosensitive drum made of a material having a high permittivity such as amorphous silicon, another failure such as density reduction in a solid image or density unevenness in a middle density image can occur due to slight dimension variation or characteristic variation.

That is, in order to ensure measure for failure at the image end and stabilization of density at the same time, it is desirable to adjust the development bias setting such that the development limit toner amount and the supply limit toner amount are equal to each other.

However, the development limit toner amount is susceptible to variation in the electric charge amount of toner, and therefore it is necessary to adjust the development bias setting to an optimum setting in each case.

In order to adjust the development bias so that the development limit toner amount and the supply limit toner amount become equal to each other, it is necessary to detect a setting that allows the development amount to be saturated, while varying the development bias. However, as shown in FIG. 12A, FIG. 12B, FIG. 12C, and FIG. 12D, a reflection-type density sensor has a characteristic in which detection sensitivity is low in a high-density region. Therefore, it is difficult to accurately detect a patch of a solid image by a reflection-type density sensor.

Further, generally, the spot diameter of a reflection-type density sensor is about 2 mm, and in the vicinity of the boundary between a high-density portion (solid image portion) and a low-density portion (halftone portion), a part of the spot overlaps the high-density portion and the other part overlaps the low-density portion. Therefore, the sensor outputs a detected waveform influenced by both regions, so that it is difficult to accurately grasp density change at the boundary portion. On the other hand, the image forming apparatus according to the present disclosure can appropriately adjust the development characteristic even in the case of using a reflection-type density sensor.

Hereinafter, embodiments of the present disclosure will be described with reference to the drawings.

Embodiment 1

Figure 1:
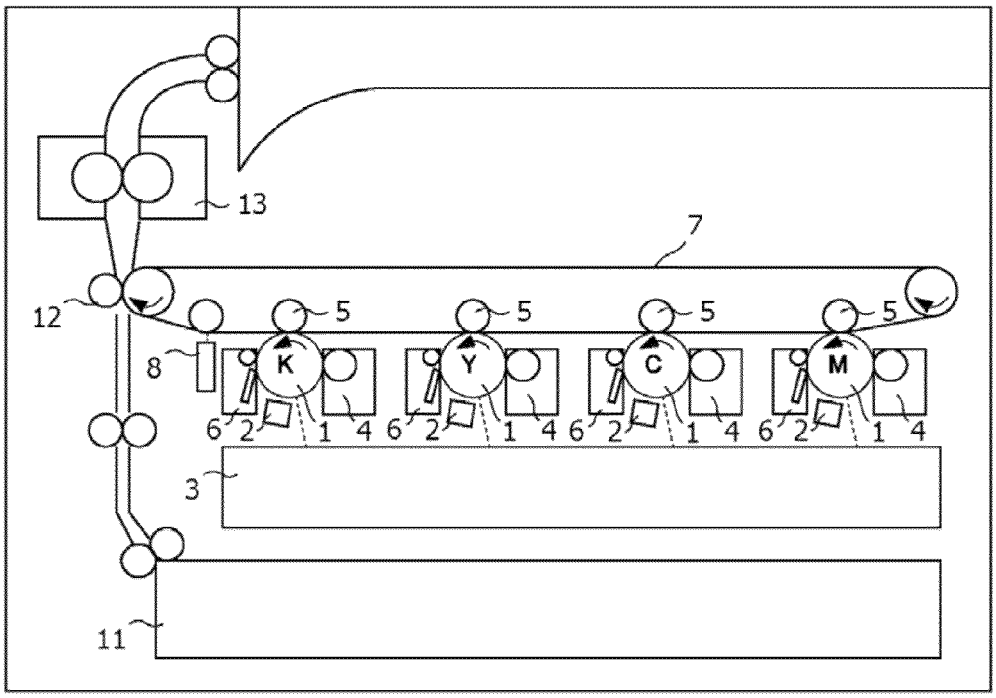
FIG. 1 is a side view showing the mechanical internal configuration of an image forming apparatus according to an embodiment of the present disclosure.

FIG. 1 is a side view showing the mechanical internal configuration of an image forming apparatus according to an embodiment of the present disclosure. The image forming apparatus is an apparatus having a print function of electrophotographic type, such as a printer, a facsimile machine, a copy machine, or a multifunction peripheral.

The image forming apparatus of the embodiment includes a color development apparatus of tandem-type. The color development apparatus includes a photosensitive drum 1, a charging device 2, an exposure device 3, a developing device 4, a transfer roller 5, a cleaning unit 6, and an electricity removing device (not shown), for each color of cyan, magenta, yellow, and black.

The photosensitive drum 1 is a cylindrical photosensitive body and is an image carrier that allows an electrostatic latent image to be formed on its surface by the exposure device 3. An inorganic photosensitive body such as an amorphous silicon photosensitive body is used for the photosensitive drum 1.

The charging device 2 charges the surface of the photosensitive drum based on a process condition, at a predetermined potential.

The exposure device 3 is a device that radiates laser light to the photosensitive drum 1 to form an electrostatic latent image thereon. The exposure device 3 includes a laser diode as a light source for the laser light, and optical elements (a lens, a mirror, a polygon mirror, and the like) for guiding the laser light to the photosensitive drum 1.

The developing device 4 develops an electrostatic latent image on the photosensitive drum 1 with toner, based on a process condition, to form a toner image.

Figure 2:
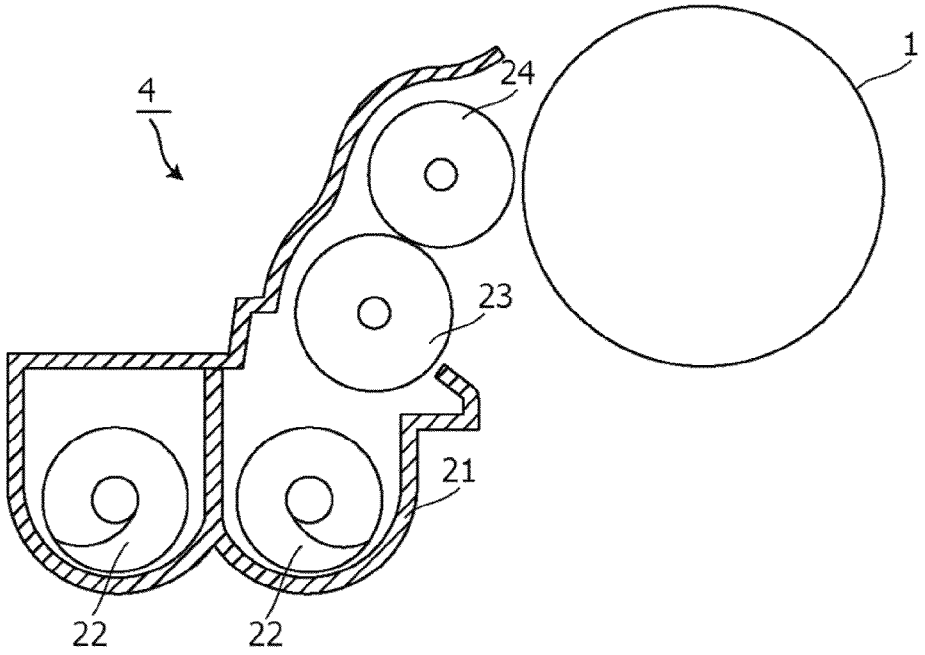
FIG. 2 is a sectional view showing an example of a developing device 4 in FIG. 1.

FIG. 2 is a sectional view showing an example of the developing device 4 in FIG. 1.

As shown in FIG. 2, the developing device 4 includes a housing 21, an agitation screw 22, a magnetic roller 23, and a developing roller 24. The developing device 4 performs development by a touchdown method, and there is a gap provided between the photosensitive drum 1 and the developing roller 24.

A toner container (not shown) is connected to the developing device 4, and toner is supplied into the housing 21 via a supply port (not shown) from the toner container. In the housing 21, a two-component developer containing toner and a carrier is agitated by the agitation screw 22. A magnetic material is used as the carrier.

The magnetic roller 23 holds the two-component developer in a brush shape on its surface. Toner in the two-component developer transfers to the developing roller 24 in accordance with a conveyance bias which is a voltage between the magnetic roller 23 and the developing roller 24.

The developing roller 24 holds the toner transferred from the magnetic roller 23, as a toner thin layer, on its surface. The toner layer formed on the surface of the developing roller 24 transfers to the photosensitive drum 1 (electrostatic latent image) by a development bias which is a voltage between the developing roller 24 and the photosensitive drum 1.

Returning to FIG. 1, the transfer roller 5 transfers a toner image on the photosensitive drum 1 onto an intermediate transfer belt 7. The cleaning unit 6 retrieves the residual toner on the photosensitive drum 1 after the transfer of the toner image to the intermediate transfer belt 7. The intermediate transfer belt 7 is a loop-shaped intermediate transfer body that contacts the photosensitive drum 1 and on which the toner image on the photosensitive drum 1 is to be transferred. The intermediate transfer belt 5 is stretched around a drive roller and the like, and circulates by a driving force from the drive roller.

The density sensor 8 is a reflection-type density sensor that radiates light to the intermediate transfer belt 7 and detects the reflected light, thereby detecting the density of a toner image on the intermediate transfer belt 7.

A transfer roller 12 causes a sheet conveyed from a sheet feed portion 11 such as a sheet feed tray to contact the intermediate transfer belt 7, thereby transferring a toner image on the intermediate transfer belt 7 onto the sheet. The sheet having the toner image transferred thereon is conveyed to a fixing device 13, and the toner image is fixed on the sheet.

Figure 3:
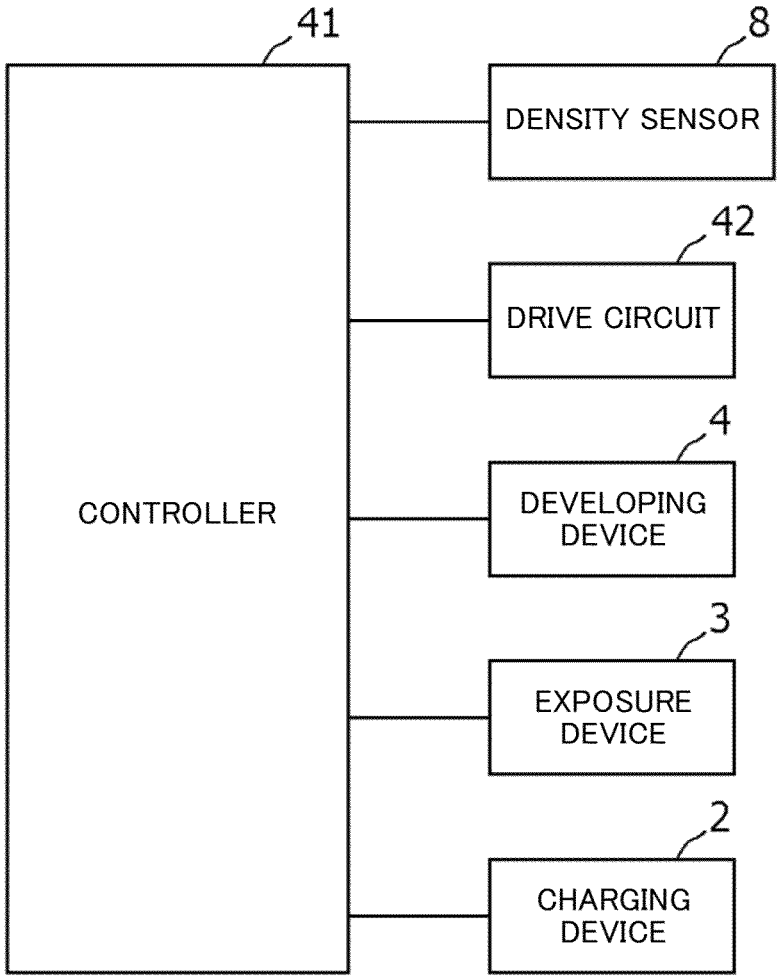
FIG. 3 is a block diagram showing the electrical configuration of the image forming apparatus according to the embodiment of the present disclosure.
Figure 4A:
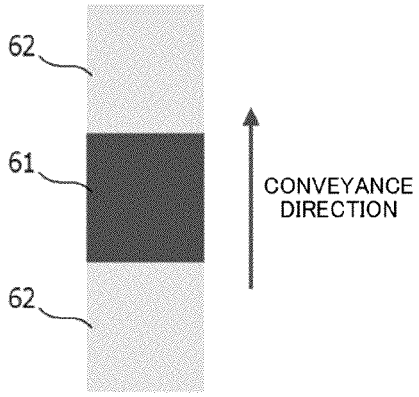
FIG. 4A, FIG. 4B, FIG. 4C, and FIG. 4D are diagrams for explaining the relationship between a development limit toner amount and a density characteristic of a density detection patch.
Figure 4B:
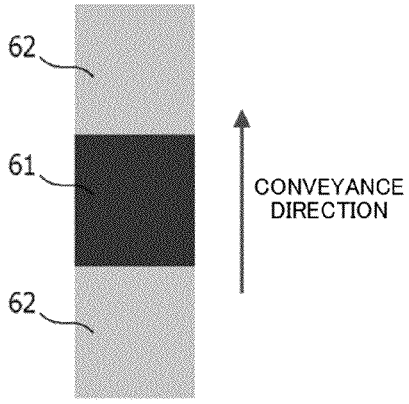
Figure 4C:
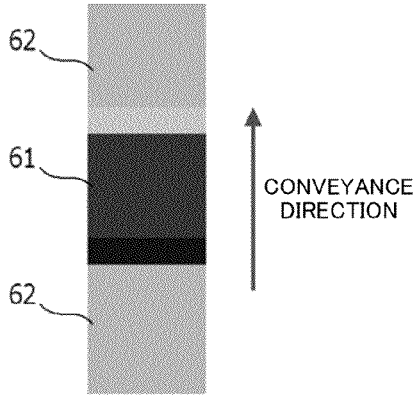
Figure 4D:
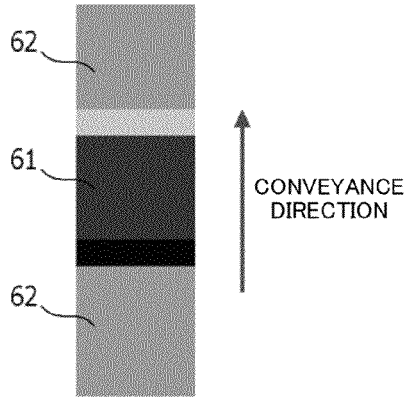

FIG. 3 is a block diagram showing the electrical configuration of the image forming apparatus according to the embodiment of the present disclosure.

As shown in FIG. 3, a controller 41 is electrically connected to a drive circuit 42 which drives a motor and the like for causing the photosensitive drum 1, the intermediate transfer belt 7, and the like to operate, a density sensor 8, the charging device 2, the exposure device 3, the developing device 4, and the like. The controller 41 controls these to execute formation of an electrostatic latent image, development of a toner image, and the like in accordance with a process condition that is set. The controller 41 is realized by a microprocessor, an ASIC (Application Specific Integrated Circuit), or the like.

In adjustment, the controller 41 forms a density detection patch as a toner image, and sets a process condition based on a density detection value of the density detection patch detected by the density sensor 8. The process condition includes, besides the development bias, a surface potential of the photosensitive drum 1, an exposure setting, a development setting, a linear velocity setting, a gap setting, and the like.

The density detection patch has a high-density portion and a low-density portion, and the high-density portion and the low-density portion are arranged close to each other such that the boundary between the high-density portion and the low-density portion intersects with the conveyance direction of the density detection patch.

Then, the controller 41 compares, in the conveyance direction, temporal change in the density detection value at a boundary portion shifting from the high-density portion to the low-density portion, with temporal change in the density detection value at a boundary portion shifting from the low-density portion to the high-density portion, and sets the process condition based on the comparison result.

Specifically, the controller 41 temporally inverts one of temporal change in the density detection value at a boundary portion shifting from the high-density portion to the low-density portion, and temporal change in the density detection value at a boundary portion shifting from the low-density portion to the high-density portion, and sets the process condition based on the difference therebetween.

In addition, the controller 41 changes the process condition to form a plurality of density detection patches in different process conditions, and sets the process condition based on a plurality of differences corresponding to the plurality of density detection patches. Specifically, the controller 41 specifies, from the plurality of differences, the minimum value of development bias that allows the whole toner thin layer on the developing roller 24 to be transferred to the photosensitive drum 1, and sets the specified minimum value of development bias, as the development bias.

Next, operation of the image forming apparatus according to embodiment 1 will be described.

The controller 41 changes the development bias to form a plurality of density detection patches with different development biases.

Figure 5:
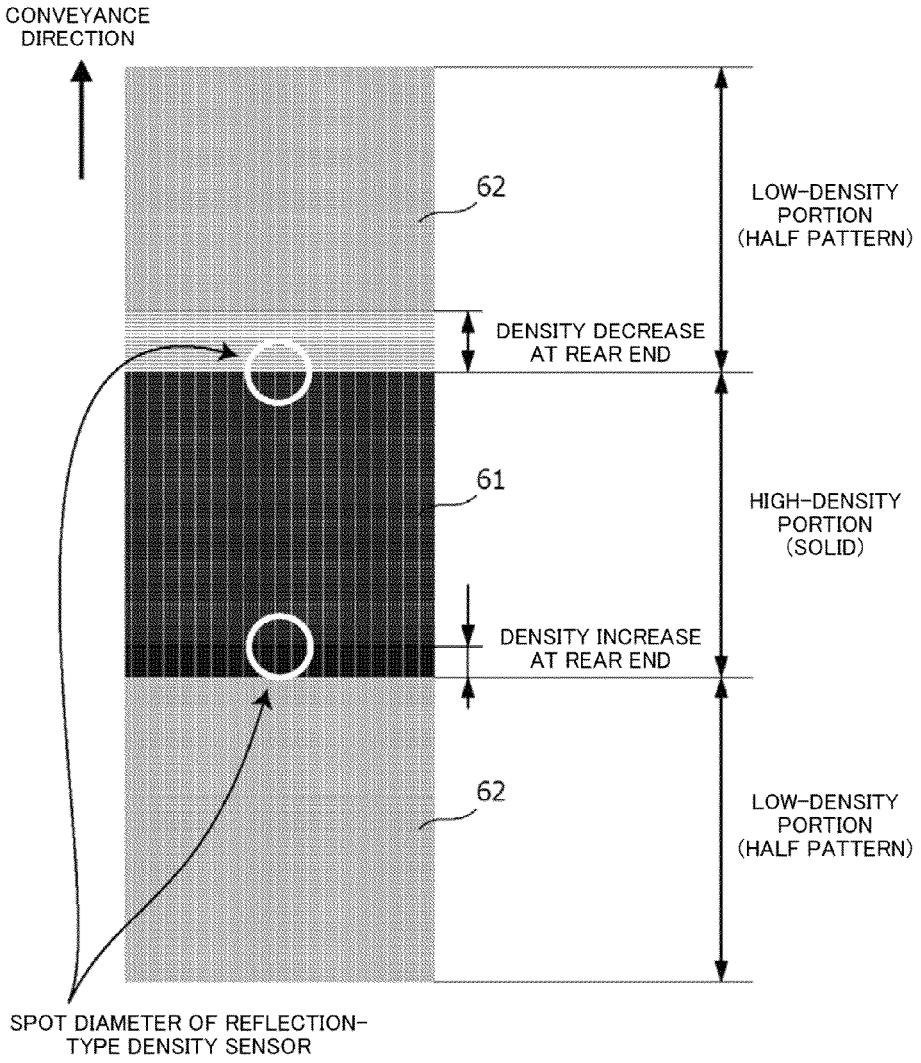
FIG. 5 is a diagram for explaining a density characteristic of a density detection patch in the case where the development limit toner amount is large.
Figure 6A:
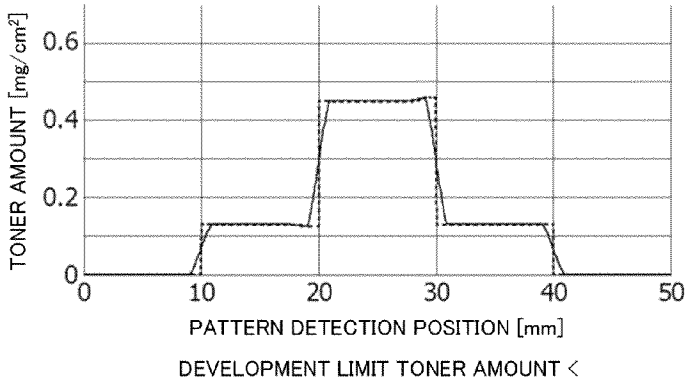
FIG. 6A, FIG. 6B, FIG. 6C, and FIG. 6D are diagrams showing examples of toner amount distributions on density detection patches, respectively corresponding to four conditions of the development limit toner amount.
Figure 6B:
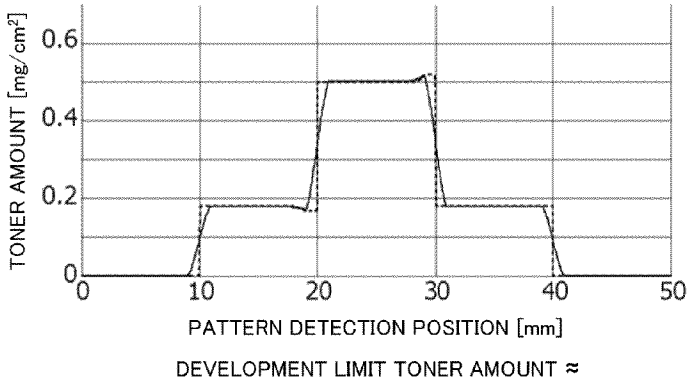
Figure 6C:
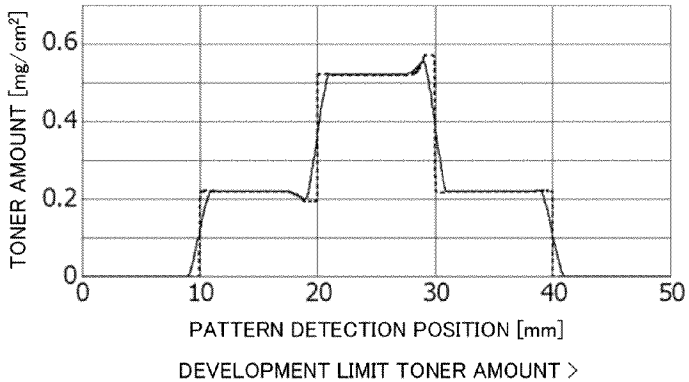
Figure 6D:
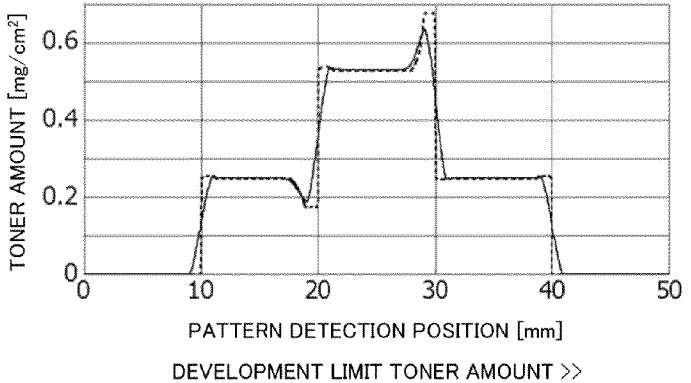
Figure 7A:
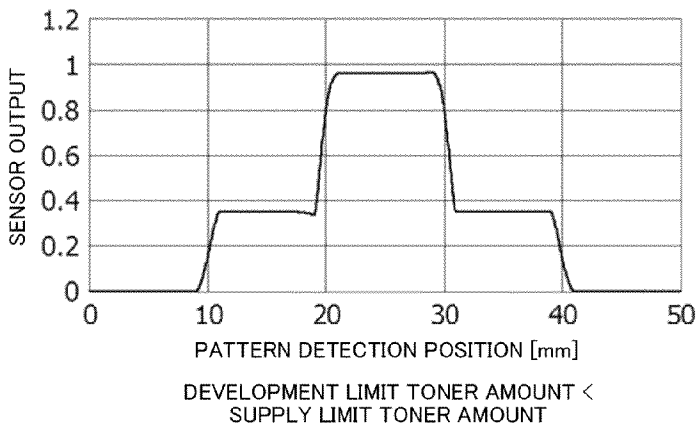
FIG. 7A, FIG. 7B, FIG. 7C, and FIG. 7D are diagrams showing examples of results of density measurements by a density sensor 8, respectively corresponding to the four conditions of the development limit toner amount in FIG. 6A, FIG. 6B, FIG. 6C, and FIG. 6D.
Figure 7B:
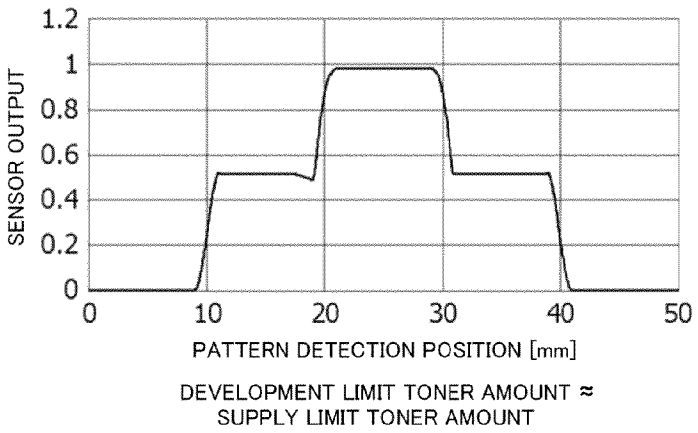
Figure 7C:
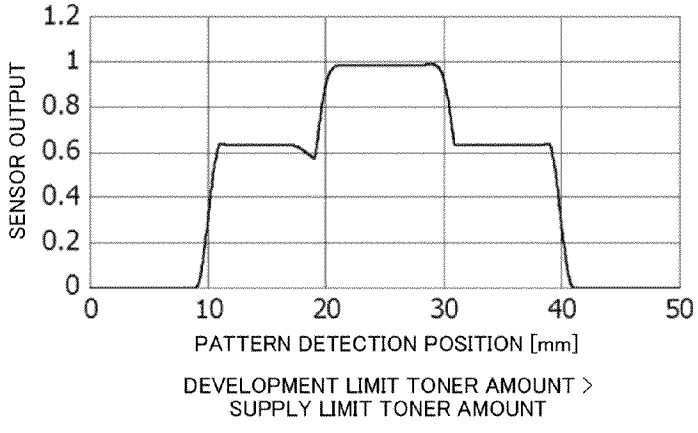
Figure 7D:
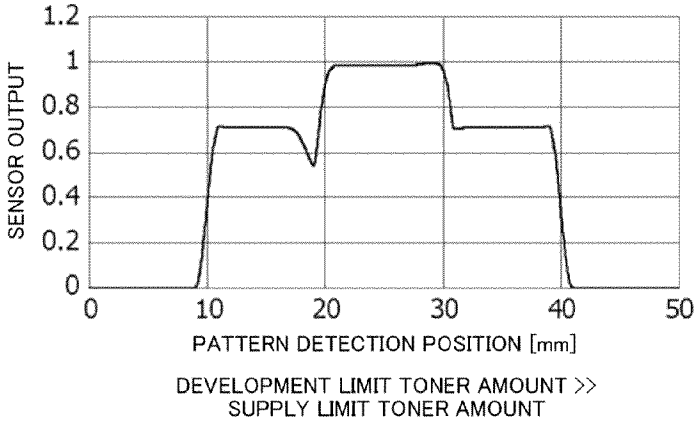
Figure 8A:
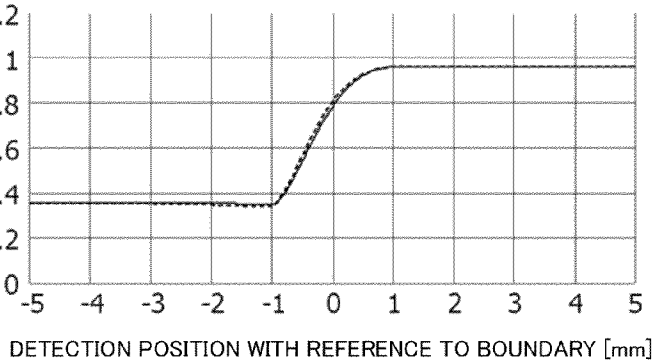
FIG. 8A, FIG. 8B, FIG. 8C, and FIG. 8D are diagrams in which, in each waveform of the density measurement results shown in FIG. 7A, FIG. 7B, FIG. 7C, and FIG. 7D, a portion shifting from a high-density portion 61 to a low-density portion 62 is temporally inverted (here, inverted with respect to the detection position coordinate, which corresponds to time), and then compared with a portion shifting from the low-density portion 62 to the high-density portion 61.
Figure 8B:
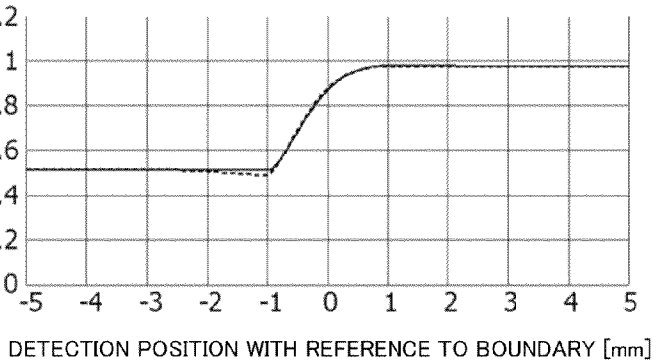
Figure 8C:
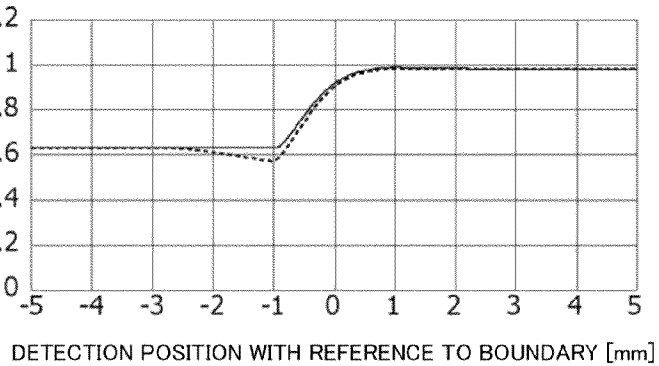
Figure 8D:
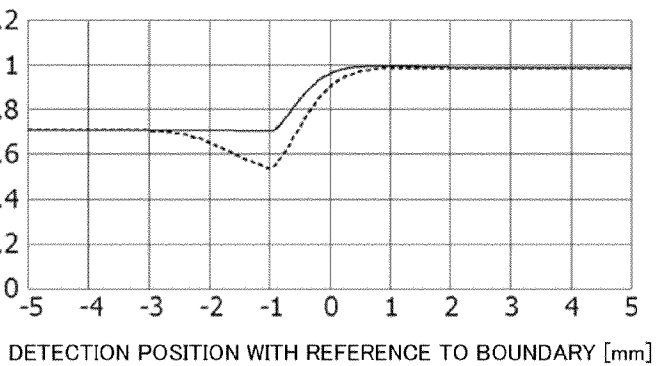

FIG. 4A, FIG. 4B, FIG. 4C, and FIG. 4D are diagrams for explaining the relationship between a development limit toner amount and a density characteristic of a density detection patch. FIG. 5 is a diagram for explaining a density characteristic of a density detection patch in the case where the development limit toner amount is large. As shown in FIG. 11A, FIG. 11B, and FIG. 11C, the higher the development bias is, the higher the development limit toner amount is. As shown in FIG. 4A, FIG. 4B, FIG. 4C, FIG. 4D, and FIG. 5, when the development limit toner amount is larger than the supply limit toner amount, density decrease occurs on the low-density side of a boundary portion shifting from a low-density portion 62 to a high-density portion 61, and density increase occurs on the high-density side of a boundary portion shifting from the high-density portion 61 to the low-density portion 62.

Then, the controller 41 acquires output waveforms from the density sensor 8, respectively corresponding to the plurality of density detection patches.

The controller 41 temporally inverts one of temporal change (i.e., output waveform) in the density detection value at a boundary portion shifting from the high-density portion to the low-density portion, and temporal change (i.e., output waveform) in the density detection value at a boundary portion shifting from the low-density portion to the high-density portion, and then specifies the difference therebetween.

FIG. 6A, FIG. 6B, FIG. 6C, and FIG. 6D are diagrams showing examples of toner amount distributions on the density detection patches, respectively corresponding to four conditions of the development limit toner amount. A solid line indicates an average toner amount in the spot of the density sensor 8, and a broken line indicates an actual toner amount. In these examples, a range of 10 mm to 20 mm of the pattern detection position corresponds to the preceding low-density portion 62, a range of 20 mm to 30 mm of the pattern detection position corresponds to the high-density portion 61, and a range of 30 mm to 40 mm of the pattern detection position corresponds to the subsequent low-density portion 62.

FIG. 7A, FIG. 7B, FIG. 7C, and FIG. 7D are diagrams showing examples of results of density measurements by a density sensor 8, respectively corresponding to the four conditions of the development limit toner amount in FIG. 6A, FIG. 6B, FIG. 6C, and FIG. 6D. As shown in FIG. 7, in the density measurement result by the density sensor 8, due to the above-described characteristic of the density sensor 8, sharp change in the density at a boundary portion cannot be accurately obtained and a high density is difficult to be accurately measured.

FIG. 8A, FIG. 8B, FIG. 8C, and FIG. 8D are diagrams in which, in each waveform of the density measurement results shown in FIG. 7A, FIG. 7B, FIG. 7C, and FIG. 7D, a portion shifting from the high-density portion 61 to the low-density portion 62 is temporally inverted (here, inverted with respect to the detection position coordinate, which corresponds to time), and then compared with a portion shifting from the low-density portion 62 to the high-density portion 61. In FIG. 8, the boundary position (pattern detection position of 20 mm in FIG. 6A, FIG. 6B, FIG. 6C, and FIG. 6D, and FIG. 7A, FIG. 7B, FIG. 7C, and FIG. 7D) shifting from the high-density portion 61 to the low-density portion 62 is made to coincide with the boundary position (pattern detection position of 30 mm in FIG. 6A, FIG. 6B, FIG. 6C, and FIG. 6D, and FIG. 7A, FIG. 7B, FIG. 7C, and FIG. 7D) shifting from the low-density portion 62 to the high-density portion 61, to compare both waveforms. In FIG. 8A, FIG. 8B, FIG. 8C, and FIG. 8D, a solid line indicates a waveform at the portion shifting from the high-density portion 61 to the low-density portion 62, and a broken line indicates a waveform at the portion shifting from the low-density portion 62 to the high-density portion 61.

Then, the controller 41 specifies the difference between both waveforms (an integrated value of the difference of the measurement value at each distance from the boundary, the maximum value of the differences, etc.), in each condition. Then, based on the difference, the controller 41 specifies the minimum value of development bias that allows the whole toner thin layer on the developing roller 24 to be transferred to the photosensitive drum 1, and sets the specified minimum value of development bias, as the development bias. That is, the development bias is set so that the development limit toner amount becomes almost equal to the supply limit toner amount.

As described above, according to the above embodiment 1, the density detection patch has the high-density portion 61 and the low-density portion 62, and the high-density portion 61 and the low-density portion 62 are arranged close to each other such that the boundary between the high-density portion 61 and the low-density portion 62 intersects with the conveyance direction of the density detection patch. Then, the controller 41 compares, in the conveyance direction, temporal change in the density detection value at a boundary portion shifting from the high-density portion 61 to the low-density portion 62, with temporal change in the density detection value at a boundary portion shifting from the low-density portion 62 to the high-density portion 61, and sets a process condition based on the comparison result.

Thus, irrespective of the characteristic of the density sensor 8 described above, the development characteristic is appropriately adjusted and the process condition is appropriately set.

Embodiment 2

In embodiment 2 of the present disclosure, the controller 41 forms a position detection patch for detecting the position of a boundary portion shifting from the high-density portion 61 to the low-density portion 62, and the position of a boundary portion shifting from the low-density portion 62 to the high-density portion 61.

Figure 9:
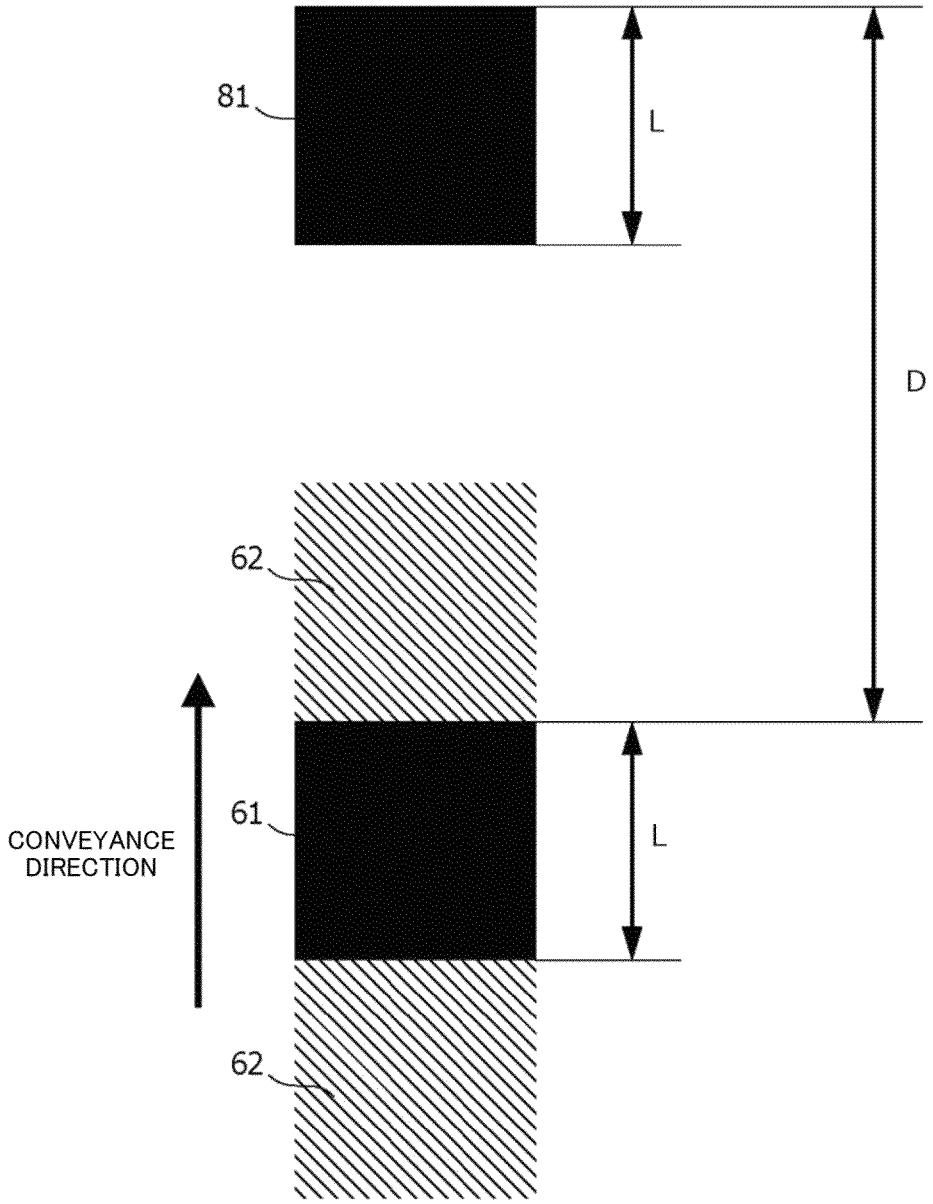
FIG. 9 is a diagram showing an example of a position detection patch in embodiment 2.

FIG. 9 is a diagram showing an example of the position detection patch in embodiment 2. As shown in FIG. 9, a length L in the conveyance direction of a position detection patch 81 is the same as the length in the conveyance direction of the high-density portion 61 or the low-density portion 62.

Then, the controller 41 specifies positions respectively separated by a predetermined distance D from positions where a rising edge and a dropping edge of a density measurement waveform of the position detection patch 81 are detected, as the position of a boundary portion shifting from the high-density portion 61 to the low-density portion 62, and the position of a boundary portion shifting from the low-density portion 62 to the high-density portion 61.

Figure 10A:
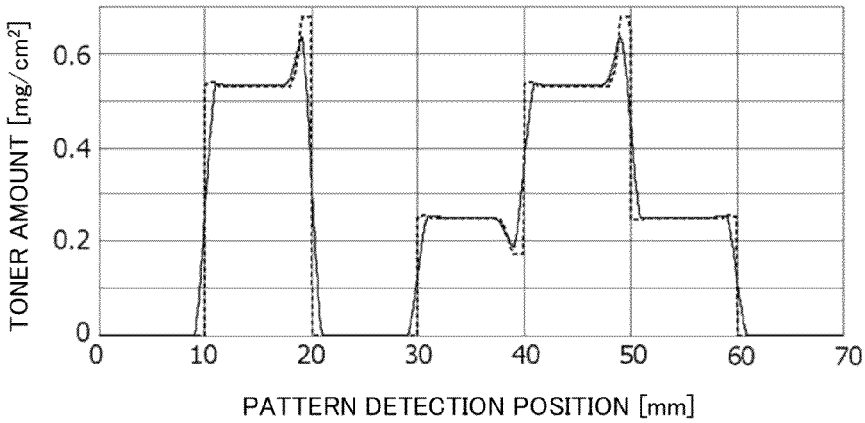
FIG. 10A is a diagram for explaining a toner amount distribution in embodiment 2.
Figure 10B:
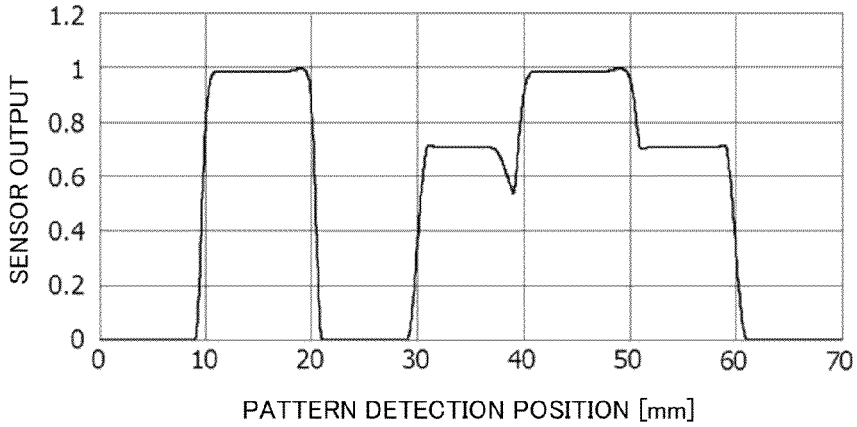
FIG. 10B is a diagram for explaining a result of density measurement by the density sensor 8.
Figure 10C:
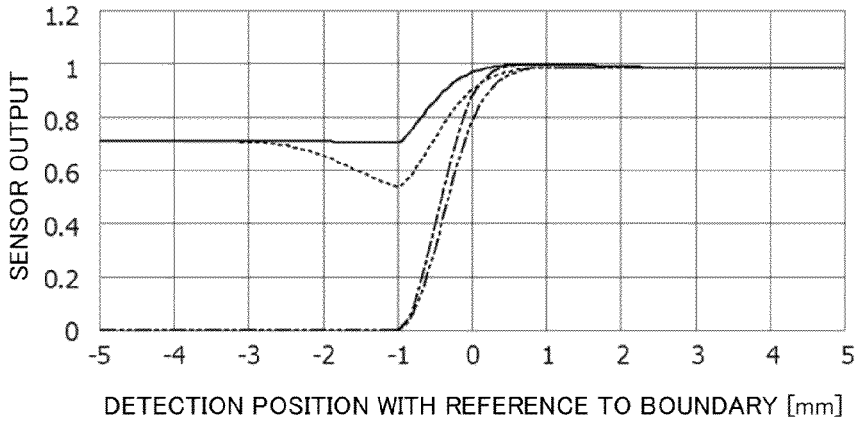
FIG. 10C is a diagram for explaining comparison between a portion shifting from the high-density portion 61 to the low-density portion 62 and a portion shifting from the low-density portion 62 to the high-density portion 61.

FIG. 10A, FIG. 10B, and FIG. 10C are diagrams for explaining a toner amount distribution in embodiment 2, a result of density measurement by the density sensor 8, and comparison between the portion shifting from the high-density portion 61 to the low-density portion 62 and the portion shifting from the low-density portion 62 to the high-density portion 61.

FIG. 10A is a diagram showing an example of a toner amount distribution on the position detection patch 81 and the density detection patch in embodiment 2. A solid line indicates an average toner amount in the spot of the density sensor 8, and a broken line indicates an actual toner amount.

FIG. 10B is a diagram showing an example of a result of density measurement by the density sensor 8 in the condition shown in FIG. 10A.

FIG. 10C is a diagram in which, in the waveform of the density measurement result shown in FIG. 10B, the portion shifting from the high-density portion 61 to the low-density portion 62 is temporally inverted (here, inverted with respect to the detection position coordinate, which corresponds to time), and then compared with the portion shifting from the low-density portion 62 to the high-density portion 61, and also, a rear end portion of the position detection patch 81 is temporally inverted (here, inverted with respect to the detection position coordinate, which corresponds to time), and then compared with a front end portion thereof. In FIG. 10C, a solid line indicates a waveform at the portion shifting from the high-density portion 61 to the low-density portion 62, and a broken line indicates a waveform at the portion shifting from the low-density portion 62 to the high-density portion 61. In addition, in FIG. 10C, a dotted-dashed line indicates a waveform at a rear end portion of the position detection patch 81, and a two-dot dashed line indicates a waveform at a front end portion of the position detection patch 81.

Thus, there is no toner before and after the position detection patch 81, and the front end and the rear end of the position detection patch 81 are accurately detected. Therefore, the position of the boundary portion shifting from the low-density portion 62 to the high-density portion 61, and the position of the boundary portion shifting from the high-density portion 61 to the low-density portion 62 can also be specified accurately through simple calculation from the front end position and the rear end position of the position detection patch 81.

The other configuration and operation of the image forming apparatus according to embodiment 2 are the same as those in embodiment 1, so the description thereof is omitted.

Although the above embodiments are preferred examples of the present disclosure, the present disclosure is not limited thereto, and various changes or modifications can be made without deviating from the gist of the present disclosure.

For example, although the density sensor 8 detects the density of a toner image on the intermediate transfer belt 7 in the above embodiments, instead, the density sensor 8 may detect the density of a toner image on the photosensitive drum 1.

The present disclosure is applicable to an image forming apparatus of electrophotographic type, for example.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photosensitive body;

a charging device configured to charge a surface of the photosensitive body based on a process condition;

an exposure device configured to radiate light to the photosensitive body, to form an electrostatic latent image;

a developing device configured to develop the electrostatic latent image with toner based on the process condition, to form a toner image;

a density sensor configured to detect a density of the toner image; and a controller configured to cause a density detection patch to be formed as the toner image and set the process condition based on a density detection value of the density detection patch detected by the density sensor, wherein the density detection patch has a high-density portion and a low-density portion, the high-density portion and the low-density portion are arranged close to each other such that a boundary between the high-density portion and the low-density portion intersects with a conveyance direction of the density detection patch, and the controller compares, in the conveyance direction, temporal change in the density detection value at a boundary portion shifting from the high-density portion to the low-density portion, with temporal change in the density detection value at a boundary portion shifting from the low-density portion to the high-density portion, and sets the process condition based on a result of the comparison.

2. The image forming apparatus according to claim 1, wherein the controller temporally inverts one of the temporal change in the density detection value at the boundary portion shifting from the high-density portion to the low-density portion and the temporal change in the density detection value at the boundary portion shifting from the low-density portion to the high-density portion, and then sets the process condition based on a difference therebetween.

3. The image forming apparatus according to claim 2, wherein the controller changes the process condition to cause a plurality of the density detection patches to be formed in different process conditions, and sets the process condition based on a plurality of the differences corresponding to the plurality of density detection patches.

4. The image forming apparatus according to claim 1, wherein the controller causes a position detection patch to be formed for detecting a position of the boundary portion shifting from the high-density portion to the low-density portion, and a position of the boundary portion shifting from the low-density portion to the high-density portion.

5. The image forming apparatus according to claim 4, wherein a length in the conveyance direction of the position detection patch is the same as a length in the conveyance direction of the high-density portion or the low-density portion.

6. The image forming apparatus according to claim 1, wherein the developing device includes a magnetic roller configured to hold a two-component developer containing a carrier and toner, and a developing roller configured to develop the electrostatic latent image with the toner transferred from the magnetic roller, and the controller forms a toner thin layer on the developing roller by a conveyance bias between the magnetic roller and the developing roller, and transfers the toner from the toner thin layer to the electrostatic latent image by a development bias between the developing roller and the photosensitive body, to develop the electrostatic latent image.

7. The image forming apparatus according to claim 6, wherein the process condition includes the development bias.

8. The image forming apparatus according to claim 7, wherein the controller specifies a minimum value of development bias that allows the whole toner thin layer on the developing roller to be transferred to the photosensitive body, and sets the specified minimum value of development bias, as the development bias.

9. The image forming apparatus according to claim 1, wherein the photosensitive body is an inorganic photosensitive body.

10. The image forming apparatus according to claim 9, wherein the photosensitive body is an amorphous silicon photosensitive body.

* * * * *